US011335253B2

(12) United States Patent
Shen et al.

(10) Patent No.: US 11,335,253 B2
(45) Date of Patent: May 17, 2022

(54) OPTICAL COMPENSATION METHOD FOR DISPLAY PANEL AND OPTICAL COMPENSATION DEVICE

(71) Applicants: CHENGDU BOE OPTOELECTRONICS TECHNOLOGY CO., LTD., Chengdu (CN); BOE TECHNOLOGY GROUP CO., LTD., Beijing (CN)

(72) Inventors: Lixia Shen, Beijing (CN); Chang Zhang, Beijing (CN); Zhiguang Zhang, Beijing (CN)

(73) Assignees: CHENGDU BOE OPTOELECTRONICS TECHNOLOGY CO., LTD., Chengdu (CN); BOE TECHNOLOGY GROUP CO., LTD., Beijing (CN)

( * ) Notice: Subject to any disclaimer, the term of this patent is extended or adjusted under 35 U.S.C. 154(b) by 323 days.

(21) Appl. No.: 16/480,448

(22) PCT Filed: Dec. 20, 2018

(86) PCT No.: PCT/CN2018/122378
§ 371 (c)(1),
(2) Date: Jul. 24, 2019

(87) PCT Pub. No.: WO2019/165830
PCT Pub. Date: Sep. 6, 2019

(65) Prior Publication Data

US 2021/0335223 A1 Oct. 28, 2021

(30) Foreign Application Priority Data

Feb. 27, 2018 (CN) ..... 201810161083.0

(51) Int. Cl.
*G09G 3/34* (2006.01)
*G09G 3/3208* (2016.01)
*G09G 3/20* (2006.01)

(52) U.S. Cl.
CPC ..... *G09G 3/3208* (2013.01); *G09G 3/2092* (2013.01); *G09G 2320/0233* (2013.01)

(58) Field of Classification Search
CPC ..... G09G 3/3208; G09G 3/2092; G09G 2320/0233; G09G 3/006; G09G 5/10;
(Continued)

(56) References Cited

U.S. PATENT DOCUMENTS 9,483,976 B2 * 11/2016 Jeon ..... G09G 3/006
10,249,264 B2 * 4/2019 Hu ..... G09G 5/10
(Continued)

FOREIGN PATENT DOCUMENTS

CN 103489405 A 1/2014
CN 103559862 A 2/2014
(Continued)

OTHER PUBLICATIONS

Extended European Search Report from European Patent Application No. 18900565.5 dated Jan. 4, 2022.

*Primary Examiner* — Jose R Soto Lopez
(74) *Attorney, Agent, or Firm* — Dilworth & Barrese, LLP.; Michael J. Musella, Esq.

(57) ABSTRACT

An optical compensation method for a display panel and an optical compensation device are provided. The optical compensation method for the display panel includes selecting a pixel block to be compensated in an edge region; and acquiring a pixel compensation parameter of at least one pixel block in a main body region as a pixel compensation parameter of the pixel block to be compensated.

14 Claims, 5 Drawing Sheets

(58) Field of Classification Search
CPC ..... G09G 2320/043; G09G 2320/0693; G09G 2360/145; G09G 2380/02; G09G 3/3233
See application file for complete search history.

(56) References Cited

U.S. PATENT DOCUMENTS

| | | | | |
|---|---|---|---|---|
| 10,276,112 | B2 | 4/2019 | Zhang | |
| 2016/0057318 | A1* | 2/2016 | Hsieh | G09G 3/36 345/88 |
| 2016/0191952 | A1* | 6/2016 | Kim | G09G 3/3233 375/240.27 |
| 2016/0196778 | A1 | 7/2016 | Cha | |
| 2017/0192140 | A1* | 7/2017 | Yoon | H01L 51/5275 |
| 2017/0206589 | A1 | 7/2017 | Jun et al. | |
| 2017/0332090 | A1* | 11/2017 | Furihata | H04N 19/426 |
| 2018/0158434 | A1* | 6/2018 | Bian | G09G 3/006 |
| 2018/0166003 | A1* | 6/2018 | Wang | G06T 5/003 |
| 2018/0191371 | A1* | 7/2018 | Tao | G09G 3/36 |
| 2018/0330682 | A1* | 11/2018 | Zhang | G09G 3/3611 |
| 2019/0139470 | A1* | 5/2019 | Yoo | H04N 13/133 |

FOREIGN PATENT DOCUMENTS

| | | | |
|---|---|---|---|
| CN | 104992657 | A | 10/2015 |
| CN | 106412549 | A | 2/2017 |
| CN | 106952627 | A | 7/2017 |

* cited by examiner

OPTICAL COMPENSATION METHOD FOR DISPLAY PANEL AND OPTICAL COMPENSATION DEVICE

The present application claims priority to Chinese patent application No. 201810161083.0, filed on Feb. 27, 2018, the entire disclosure of which is incorporated herein by reference as part of the present application.

TECHNICAL FIELD

At least one embodiment of the present disclosure relates to an optical compensation method for a display panel and an optical compensation device.

BACKGROUND

Compared to a Liquid Crystal Display (LCD), an Organic Light-Emitting Diode (OLED) display apparatus has various advantages of high contrast, ultra thinness, bendability and the like, and thus is more and more widely applied to high-performance display. Currently, brightness non-uniformity and afterimages are two main difficult problems which the OLED faces. In order to solve the technical problems of brightness non-uniformity and afterimages in the OLED, in addition to improvement of the process, there is a compensation technology.

SUMMARY

At least one embodiment of the present disclosure provides an optical compensation method for a display panel and an optical compensation device.

At least one embodiment of the present disclosure provides an optical compensation method for a display panel, the display panel comprises a main body region and an edge region located at a periphery of the main body region. The optical compensation method comprises: selecting a pixel block to be compensated in the edge region; and acquiring a pixel compensation parameter of at least one pixel block in the main body region as a pixel compensation parameter of the pixel block to be compensated.

For example, acquiring the pixel compensation parameter of the at least one pixel block in the main body region as the pixel compensation parameter of the pixel block to be compensated comprises: acquiring a pixel compensation parameter of a first pixel block in the main body region, which is the closest to a second pixel block to be compensated, as a pixel compensation parameter of the second pixel block.

For example, pixel blocks on the display panel are arranged along a row direction and a column direction, and acquiring the pixel compensation parameter of the at least one pixel block in the main body region as the pixel compensation parameter of the pixel block to be compensated further comprises: determining an alignment mode of the second pixel block and the first pixel block, the alignment mode comprising row alignment or column alignment; and using the pixel compensation parameter of the second pixel block as a pixel compensation parameter of a plurality of third pixel blocks to be compensated positioned in a same row or a same column with the second pixel block according to the alignment mode.

For example, before acquiring the pixel compensation parameter of the at least one pixel block in the main body region as the pixel compensation parameter of the pixel block to be compensated, the optical compensation method further comprises: judging whether a fourth pixel block to be compensated which is not in the row alignment or in the column alignment with the first pixel block in the main body region exists in the edge region; and determining a region where the fourth pixel block is positioned as a corner region of the edge region if the fourth pixel block exists in the edge region.

For example, the pixel compensation parameter of the first pixel block which is the closest to the corner region is used as a pixel compensation parameter of the fourth pixel block in the corner region, and the pixel compensation parameters of the fourth pixel blocks positioned in a same corner region are all the same.

For example, acquiring the pixel compensation parameter of the at least one pixel block in the main body region of the display panel comprises: acquiring picture data displayed by the display panel; identifying a color difference or brightness difference between the at least one pixel block in the main body region and at least one pixel block in a tested picture on the basis of color distribution or brightness distribution of the picture data; and acquiring the pixel compensation parameter of the at least one pixel block in the main body region by utilizing a compensation algorithm according to the color difference or brightness difference between the at least one pixel block in the main body region and the at least one pixel block in the tested picture.

For example, the pixel compensation parameter comprises an offset and a gain which are calculated according to the at least one pixel block in the main body region.

For example, acquiring the picture data displayed by the display panel comprises: adopting a camera to shoot to acquire the picture data displayed by the display panel.

For example, the compensation algorithm comprises an optical compensation algorithm.

For example, after acquiring the picture data displayed by the display panel, the optical compensation method further comprises: identifying the color difference or brightness difference between the pixel block in the display panel and the pixel block in the tested picture on the basis of the color distribution or brightness distribution of the picture data, and partitioning the display panel into the edge region and the main body region according to a size of the color difference or brightness difference. The color difference or brightness difference of the edge region is greater than that of the main body region.

For example, the optical compensation method further comprises: reading the pixel compensation parameter of the pixel block in the main body region of the display panel and a regulated pixel compensation parameter of the pixel block to be compensated in the edge region; and inputting the pixel compensation parameter of the main body region and the regulated pixel compensation parameter of the edge region into the display panel so as to compensate a display operation for the display panel.

For example, selecting the main body region and the edge region of the display panel comprises: acquiring a brightness test result of the display panel, and partitioning the display panel into the edge region with low brightness and the main body region with high brightness according to the test result; or partitioning the display panel into a plurality of regions in advance. The plurality of regions comprise at least one edge region and at least one main body region.

For example, the display panel comprises a curved screen, and the curved screen comprises a plane portion positioned in the main body region and a curved surface portion positioned in the edge region.

For example, the pixel block comprises N*M pixels, N is an integer between 1 and 10, and M is an integer between 1 and 10.

At least one embodiment of the present disclosure provides an optical compensation device, which comprises: a processor; and a memory configured to store a computer program instruction. The computer program instruction is applicable to be loaded by the processor and execute the optical compensation method for the display panel.

For example, the optical compensation device comprises a camera, configured to shoot a picture displayed by the display panel and send the picture into the processor so as to acquire the pixel compensation parameter of the at least one pixel block in the main body region of the display panel.

BRIEF DESCRIPTION OF THE DRAWINGS

In order to clearly illustrate the technical solutions of the embodiments of the disclosure, the drawings of the embodiments will be briefly described in the following; it is obvious that the described drawings are only related to some embodiments of the disclosure and thus are not limitative to the disclosure.

DETAILED DESCRIPTION

In order to make objects, technical details and advantages of the embodiments of the disclosure apparent, the technical solutions of the embodiments will be described in a clearly and fully understandable way in connection with the drawings related to the embodiments of the disclosure. Apparently, the described embodiments are just a part but not all of the embodiments of the disclosure. Based on the described embodiments herein, those skilled in the art can obtain other embodiment(s), without any inventive work, which should be within the scope of the disclosure.

It should be noted that, the terms "first," "second," etc., which are used in the present disclosure, are not intended to indicate any sequence, amount or importance, but distinguish various components. It should be understood that the terms used as mentioned above can be interchanged in an appropriate circumstance so that the embodiments of the present disclosure described herein can be implemented in an order other than those illustrated or described herein. In addition, the terms "comprise," "comprising," "include," "including," and any variations thereof are intended to cover non-exclusive inclusion, for example, a process, method, system, product, or apparatus that includes a series of steps or elements need not be limited to those steps or elements that are explicitly listed, but may include other steps or elements that are not explicitly listed or inherent to such process, method, product or apparatus.

Generally, electroluminescent display panels comprise an Active Matrix Organic Light-Emitting Diode (AMOLED) display panel, an Active Matrix Quantum dot Light-Emitting Diode (AMQLED) display panel, a Passive Matrix Organic Light-Emitting Diode (PMOLED) display panel and a Passive Matrix Quantum dot Light-Emitting Diode (PMQLED) display panel. The electroluminescent display panel is widely applicable to different fields. For example, in the field of commerce, the electroluminescent display panel can be applicable to a Point-Of-Sale (POS) machine, an Automatic Teller Machine (ATM) machine, a copier, a game machine and the like; in the field of communications, the electroluminescent display panel can be applicable to a mobile phone, a mobile network terminal and the like; in the field of a computer, the electroluminescent display panel can be applicable to a Personal Digital Assistant (PDA), a commercial Personal Computer (PC), a domestic PC, a notebook computer and the like; in the field of consumer electronic products, the electroluminescent display panel can be applicable to a sound device, a digital camera, a portable Digital Video Disc (DVD) and the like; in the field of industrial application, the electroluminescent display panel can be applicable to instruments and apparatus and the like; and in the field of traffic, the electroluminescent display panel can be applicable to a Global Positioning System (GPS), an aircraft instrument and the like.

Figure 1:
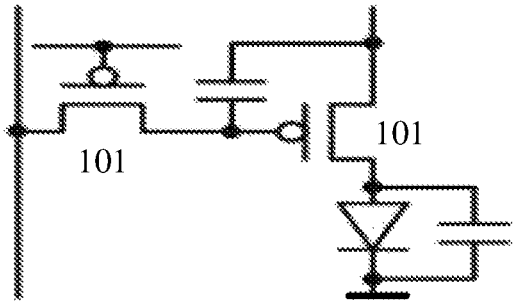
FIG. 1 is a schematic diagram of an OLED pixel circuit according to an embodiment of the present disclosure.

For example, as shown in FIG. 1, a general OLED pixel circuit for the AMOLED comprises two thin film transistors 101 and a capacitor, and the pixel circuit can be called as a 2T1C pixel circuit. A low temperature polycrystalline silicon thin film transistor (LTP-Si TFT) is mostly adopted in a small or medium-sized OLED display panel, and the low temperature polycrystalline silicon thin film transistor has higher mobility and small occupied area, and is more suitable for a high Pixels Per Inch (PPI) application; and an oxide thin film transistor is mostly adopted in a large-sized OLED display panel, and the oxide thin film transistor is better in uniformity, compatible to a common amorphous silicon thin film transistor (a-Si TFT) in process, and is more suitable to produce on a production line.

For the OLED pixel circuit used in the small or medium-sized OLED display panel, due to limitation of a crystallization process for forming a polycrystalline silicon active layer of the thin film transistor, the low temperature polycrystalline silicon thin film transistors at different positions generally have non-uniformity in electrical parameters such as threshold voltage and mobility, and such non-uniformity can be converted into a current difference and a brightness difference of the OLED display panel and sensed by human eyes (i.e., a mura phenomenon). For the OLED pixel circuit used in the large-sized display panel, the oxide thin film transistor is relatively good in process uniformity, but a threshold voltage of the oxide thin film transistor can be drifted under long-time pressurization and high temperature. Due to different displayed pictures, the threshold drift amounts of thin film transistors at respective portions of the panel are different, which may cause a difference in display brightness. Such difference is related to a previously displayed image, and thus generally appears as an afterimage phenomenon, also known as afterimage.

In the current process, no matter whether it is the low temperature polycrystalline silicon thin film transistor or the oxide thin film transistor, there is a problem of non-uniformity or non-stability, and the OLED also may be attenuated in brightness along with increase of lighting time. Those problems are difficult to completely solve in process and have to be solved by various compensation technologies.

Currently, the technical problems of brightness non-uniformity and afterimage in the OLED display panel can be solved by an internal compensation technology or an external compensation technology. The internal compensation technology refers to a method for carrying out compensation inside a pixel by utilizing a compensation sub-circuit constructed by the thin film transistor. The external compensation technology refers to a method for carrying out compensation after sensing electrical or optical characteristics of the pixel by an external driving circuit or device.

In the study, an inventor of the application finds that: an optical compensation method for the electroluminescent display panel involves sensing optical characteristics of a pixel by an external driving circuit or device and then carrying out compensation. For example, in the optical compensation method, the electroluminescent display panel is shot by a camera, the optical characteristics of each pixel in the electroluminescent display panel are acquired by a shot image, and the optical compensation is performed on the basis of the optical characteristics of each pixel in the electroluminescent display panel, which are sensed by the camera. However, according to the optical compensation method, when the structure of the electroluminescent display panel is not flat, for example, when the display panel is a curved display panel, the curved display panel may have a phenomenon that brightness of an edge of the curved display panel may be higher than that of a non-edge portion of the curved display panel, after optical compensation.

Figure 2:
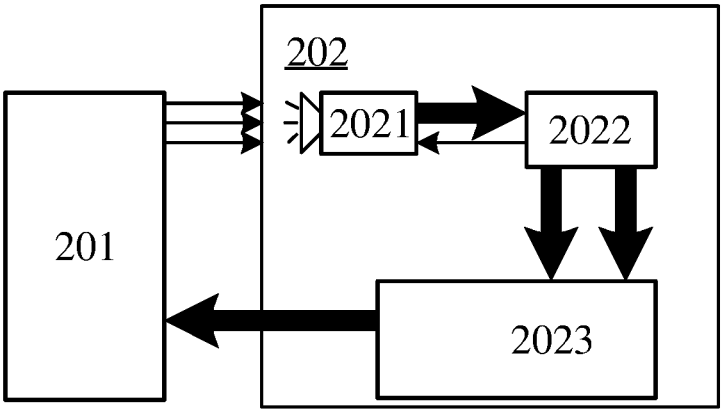
FIG. 2 is a schematic diagram of an external optical compensation system according to an embodiment of the present disclosure.

At least one embodiment of the present disclosure provides an optical compensation system. The optical compensation system can be used for solving the problem that after optical compensation, the electroluminescent display panel has the phenomenon that brightness of the edge portion of the display panel is higher than that of the non-edge portion of the display panel. The optical compensation system is as shown in FIG. 2. It should be noted that, a hardware environment and structure shown in FIG. 2 merely are exemplary, but not restrictive; and as required, the hardware environment may also have other components and structures, and for example, may comprise an image processing integrator and the like.

For example, as shown in FIG. 2 which is a schematic diagram of an external optical compensation system, the optical compensation system comprises a display panel 201 and an optical compensation device 202, and the optical compensation device 202 comprises a camera 2021, a data processing unit 2022 and a control unit 2023 which are in a signal connection in a wired or wireless mode.

At least one embodiment of the present disclosure is illustrated by taking the AMOLED display panel as an example. The AMOLED display panel may comprise a data decoding circuit, a timing controller (Tcon), a gate driving circuit, a data driving circuit, a storage apparatus (for example, a flash memory and the like) and the like, in addition to a pixel array. The data decoding circuit receives a display input signal and decodes the display input signal to obtain a display data signal; and the timing controller outputs a timing signal to control the gate driving circuit, the data driving circuit and the like to synchronously work, and can carry out gamma processing on the display data signal and input the processed display data signal to the data driving circuit to perform a display operation. For example, the timing controller, upon performing a gamma processing on the display data signal, can also simultaneously perform a compensation processing. For example, the timing controller can read a pre-stored pixel compensation parameter from the storage apparatus and further process the display data signal by adopting the pixel compensation parameter to obtain the compensated display data signal. And after the timing controller completing the gamma processing and the compensation processing, outputs the display data signal to the data driving circuit for the display operation. Or, the display panel also can comprise an independent gamma processing circuit which performs gamma processing, compensation processing and the like on the display data signal under the control of the timing controller.

Figure 3A:
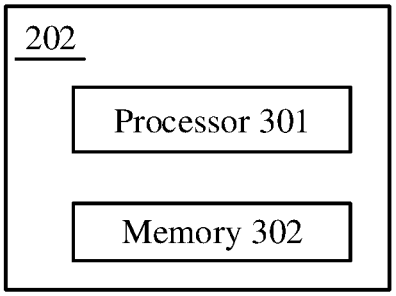
FIG. 3A is a schematic diagram of an optical compensation device according to an embodiment of the present disclosure.

In one embodiment, as shown in FIG. 3A, the optical compensation device 202 comprises a processor 301 and a memory 302. The memory 302 is configured to store a computer program instruction, and the computer program instruction is applicable to be loaded by the processor 301 and execute the optical compensation method for the display panel (which will be illustrated in detail later), and achieves functional effects of each functional module (for example, the data processing unit 2022 and the control unit 2023) in FIG. 2. The processor 301 may be any one of various applicable processor, for example, is implemented in a form of a central processor, a microprocessor, an embedded processor and the like, and may adopt architectures of X86, ARM and the like; and the memory 302 may be any one of various applicable storage apparatus, such as a non-volatile storage apparatus, which comprise, but are not limited to a magnetic storage apparatus, a semiconductor storage apparatus, an optical storage apparatus and the like, and can be arranged in a form of a single storage apparatus, a storage apparatus array or a distributed storage apparatus, and the embodiments of the present disclosure are not limited thereto.

Figure 3B:
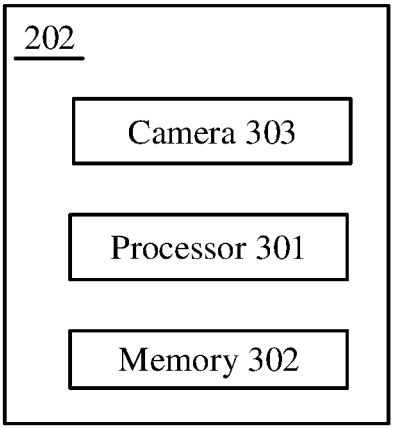
FIG. 3B is a schematic diagram of an optical compensation device according to an embodiment of the present disclosure.

For example, in at least one embodiment, as shown in FIG. 3B, the optical compensation device 202 comprises a processor 301, a memory 302 and a camera 303. The processor 301 and the memory 302 herein have the same structure and function as the processor 301 and the memory 302 shown in FIG. 3A, and are not repeated herein. The camera 303 is configured to shoot a picture displayed by the display panel and send the shot picture into the processor so as to acquire display parameters of a plurality of pixels on the display panel.

For example, as shown in FIG. 2, the data processing unit 2022 of the optical compensation device 202 sends out a test image to the control unit 2023, and the control unit 2023 processes the test image to acquire a pixel compensation parameter and inputs the pixel compensation parameter into the storage apparatus of the display panel 201 to store so as to drive the display panel 201 to display the image when the display panel works. The operation that the control unit acquires the pixel compensation parameter can comprise: acquiring pixel compensation parameters of all pixels on the display panel, and storing the pixel compensation parameters in the storage apparatus for retrieving when the display panel displays the image subsequently. Or, the control unit acquires pixel compensation parameters of a part of pixels on the display panel and uses the pixel compensation parameters for compensating brightness non-uniformity of the display panel in real time. The camera 2021 shoots to acquire brightness information of each pixel of the tested display panel 201 in a selected gray scale. The data processing unit 2022 processes to obtain an actual measured brightness and gray scale response curve of each pixel, and then writes a compensation multinomial coefficient into the storage apparatus in the display panel 201 under the control of the control unit 2023 on the basis of an ideal brightness and gray scale response curve according to a method for changing brightness by regulating the gray scale, e.g., a method for performing curve fitting on a gray scale after compensation and an input gray scale by using a multinomial and finally obtaining the compensation multinomial coefficient. When the display panel 201 normally works, the control unit (e.g., the timing controller) in the display panel 201 reads those multinomial coefficients for pixel compensation from the storage apparatus and processes to obtain a corrected gray scale of each gray scale of each pixel so as to implement real-time compensation on brightness non-uniformity of each pixel and finally alleviate brightness non-uniformity of the display panel 201. Similarly, each pixel of the OLED display panel can be subjected to color non-uniformity compensation.

Illustration will be carried out below by taking bright compensation as an example, but the embodiments of the present disclosure do not make any limit thereto.

It should be noted that the camera 2021 comprises, but is not limited to, a charge coupled device (CCD) camera and a complementary metal oxide semiconductor (CMOS) camera. The camera 2021 herein, for example, is a CCD camera with high resolution and high accuracy.

However, the optical compensation method as mentioned above has the difficulty of how to accurately capture correct brightness of each pixel by the camera 2021, particularly when the structure of the display panel is not flat. For example, the display panel 201 can be a curved display panel, and for example, two side edges or four side edges of the curved display panel have a shape of a circular arc, so that a narrower frame can be implemented. When the curved display panel 201 is tested, the camera 2021 cannot accurately capture correct brightness of pixels at a curved edge portion of the display panel 201, and for the pixels at the curved edge portion, a brightness value obtained by shooting is lower than actual brightness values of those portions of the display panel 201, resulting in that after the optical compensation, the display panel 201 has a phenomenon that brightness of the edge portion is higher than that of a non-edge portion.

Figure 4:
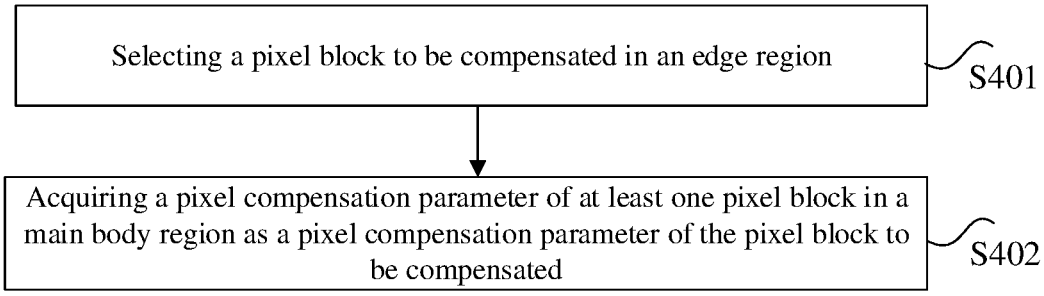
FIG. 4 is a schematic flow chart of an optical compensation method for a display panel according to an embodiment of the present disclosure.

At least one embodiment of the present disclosure provides a flow chat of an optical compensation method for a display panel as shown in FIG. 4. For example, the method can be applied to an optical compensation device 202, and is loaded and executed by a processor 301 so as to at least solve the problem that brightness of the edge of the curved display panel is higher than that of the non-edge portion of the curved display panel after the curved display panel performing the optical compensation. It should be noted that the steps shown in the flow chat of the drawing can be executed in a computer system such as a group of computer executable instructions, and a logic sequence is shown in the flow chart, but in some cases, the shown or described steps can be executed in a different sequence. As shown in FIG. 4, the method can comprise the following steps:

S401: selecting a pixel block to be compensated in an edge region;

S402: acquiring a pixel compensation parameter of at least one pixel block in a main body region as a pixel compensation parameter of the pixel block to be compensated.

The pixel block as mentioned above comprises at least one pixel, i.e., the pixel block comprises N*M pixels. N is an integer between 1 and 10, and M is an integer between 1 and 10.

Figure 5:
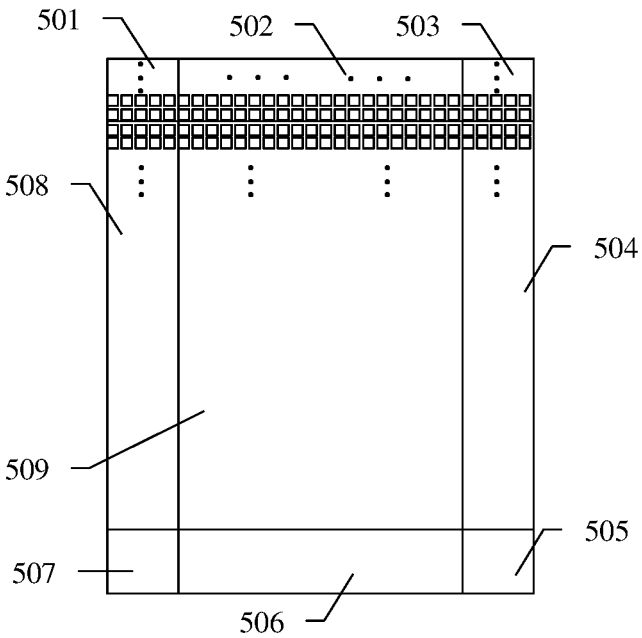
FIG. 5 is a schematic diagram that a display panel is partitioned into a plurality of regions according to an embodiment of the present disclosure.

As shown in FIG. 5, the pixel blocks P on the display panel are arranged along a row direction and a column direction.

For example, acquiring pixel compensation parameters of a plurality of pixel blocks on the display panel can comprise steps as follows. The OLED display panel receives a test image (e.g., a uniform gray scale image) sent out by a control unit of the optical compensation device. Upon the OLED display panel displaying a picture of the test image, the picture displayed by the OLED display panel is shot by a camera; and an image of the shot display picture is sent into a data processing unit to be processed and analyzed to acquire display parameters (e.g., color or brightness and the like) of corresponding pixels of the display panel, so as to acquire the pixel compensation parameter of each pixel block of the display panel.

For example, picture data of the test image displayed by the display panel is acquired; on the basis of color distribution or brightness distribution of the picture data, a color difference or brightness difference between each pixel block of the display panel and each pixel block in a target test picture is identified; and according to a size of the color difference or brightness difference between each pixel block of the display panel and each pixel block in the target test picture, the display panel is partitioned into the main body region and the edge region, and the color difference or brightness difference of the edge region is greater than that of the main body region. Then, according to the color difference or brightness difference between the pixel block in the main body region and the pixel block in the target test picture, the pixel compensation parameter of the pixel block in the main body region is acquired by utilizing a compensation algorithm.

The method of optical compensation can be performed with reference to the optical compensation device 202 in FIG. 2. For example, the picture data of the test image displayed by the display panel 201 is acquired by using the high-resolution and high-accuracy CCD camera 2021, and the CCD camera 2021 sends the picture data to the data processing unit 2022 after shooting the picture data. The data processing unit 2022 analyzes color distribution or brightness distribution characteristics of each pixel block of the display panel according to the acquired picture data and identifies the color difference or brightness difference (i.e., mura) between each pixel block of the display panel and each pixel block in the target test picture according to a related algorithm. The related algorithm includes, but is not limited to, an optical measurement method. Then, according to mura data of each pixel block of the display panel and a corresponding optical compensation algorithm, the pixel compensation parameters, i.e., an offset and a gain, of each pixel block of the display panel is calculated. The optical compensation algorithm includes, but is not limited to, a Demura compensation algorithm.

After the pixel block to be compensated in the edge region is selected, the pixel compensation parameter of the pixel block in the main body region, which is acquired by the optical compensation device 202, is used as the pixel compensation parameter of the pixel block to be compensated.

The embodiments are not limited thereto. The pixel compensation parameter of the pixel block to be compensated in the edge region also can be acquired when the pixel compensation parameter of the pixel block in the main body region is acquired, and then the pixel compensation parameter of the pixel block to be compensated is regulated to be consistent with the pixel compensation parameter of the pixel block in the main body region.

In an example as shown in FIG. 5, the display panel 201 comprises an edge region 501, an edge region 502, an edge region 503, an edge region 504, an edge region 505, an edge region 506, an edge region 507, an edge region 508 and a main body region 509 positioned in a plurality of edge regions.

Herein, selecting the edge region of the display panel further can be implemented in two modes as follows:

Mode I: acquiring a brightness test result of the picture data displayed by the display panel, partitioning the display panel into the edge region with low brightness and the main body region with high brightness according to the brightness test result, and selecting the edge region of the display panel on the basis of the partitioned edge region and main body region.

Mode II: partitioning the display panel into a plurality of regions in advance, as shown in FIG. 5. The plurality of regions comprise at least one edge region and at least one main body region, and the edge region of the display panel is directly selected on this basis.

For example, n rows or m columns of pixels which are inwards from a side edge are selected as the edge region, n and m are integers greater than 1 and for example, are 5 to 15, and values of n and m can be selected based on experience or selected according to design parameters of the display panel.

After the pixel block to be compensated in the edge region is selected, the pixel compensation parameter of the pixel block in the main body region, which is the closest to the pixel block to be compensated, can be extracted from the acquired pixel compensation parameters of a plurality of pixel blocks in the main body region and used as the pixel compensation parameter of the pixel block to be compensated.

In the above-mentioned mode, the compensation parameter of the edge region of the curved display panel (i.e., a flexible screen) can be separately controlled, so that after the curved display panel is subjected to optical compensation, uniformity of brightness of the edge region and brightness of the main body region of the curved display panel is implemented, and the afterimage can be further weakened.

Moreover, according to an embodiment of the present disclosure, acquiring the pixel compensation parameter of at least one pixel block in the main body region as the pixel compensation parameter of the pixel block to be compensated comprises: acquiring a pixel compensation parameter of a first pixel block in the main body region, which is the closest to a second pixel block to be compensated, as a pixel compensation parameter of the second pixel block.

Figure 6:
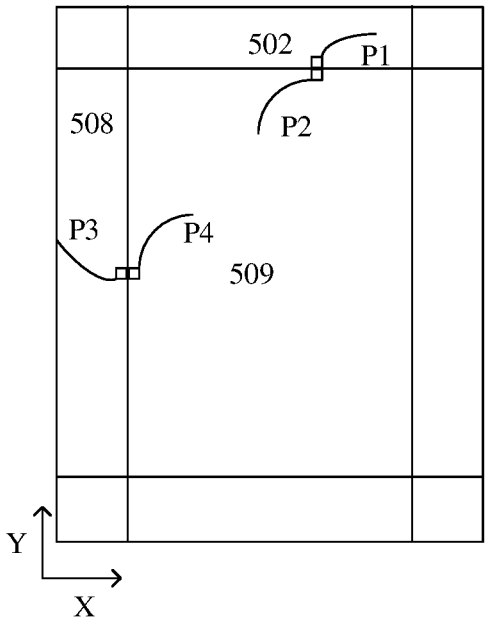
FIG. 6 is a schematic diagram of a pixel block in a display panel according to an embodiment of the present disclosure.

For example, as shown in FIG. 6, the main body region 509 comprises a pixel block P2 and a pixel block P4, i.e., the first pixel blocks; and the edge region 502 comprises a pixel block P1, and the edge region 508 comprises a pixel block P3, i.e., the second pixel blocks. The pixel block P1 and the pixel block P2 are adjacent in the column direction (i.e., a Y direction as shown in FIG. 6), and the pixel block P3 and the pixel block P4 are adjacent in the row direction (i.e., an X direction as shown in FIG. 6). According to the embodiments of the present disclosure, the pixel compensation parameters of the pixel block P2 and the pixel block P4, which have been acquired previously, can be acquired, and then the pixel compensation parameter of the pixel block P2 can be used as the pixel compensation parameter of the pixel block P1 in the edge region 502 and the pixel compensation parameter of the pixel block P4 can be used as the pixel compensation parameter of the pixel block P3 in the edge region 508, so that the pixel compensation parameter of the pixel block P1 in the edge region 502 is consistent with that of the pixel block P2 in the main body region 509, which is adjacent to the pixel block P1, and the pixel compensation parameter of the pixel block P3 in the edge region 508 is consistent with that of the pixel block P4 in the main body region 509, which is adjacent to the pixel block P3. Consistency of the pixel parameters herein means that the pixel compensation parameter of the pixel block in the edge region is regulated to be the same with that of the pixel block in the main body region, which is adjacent to the edge region, i.e., both the offset and the gain of the pixel block in the edge region are the same as that of the pixel block in the main body region adjacent to the edge region.

In another example, acquiring the pixel compensation parameter of at least one pixel block in the main body region as the pixel compensation parameter of the pixel block to be compensated further comprises: determining an alignment mode of the second pixel block and the first pixel block, the alignment mode comprising row alignment or column alignment; and using the pixel compensation parameter of the second pixel block as pixel compensation parameters of a plurality of third pixel blocks to be compensated positioned in the same row or the same column with the second pixel block according to the alignment mode.

Figure 7:
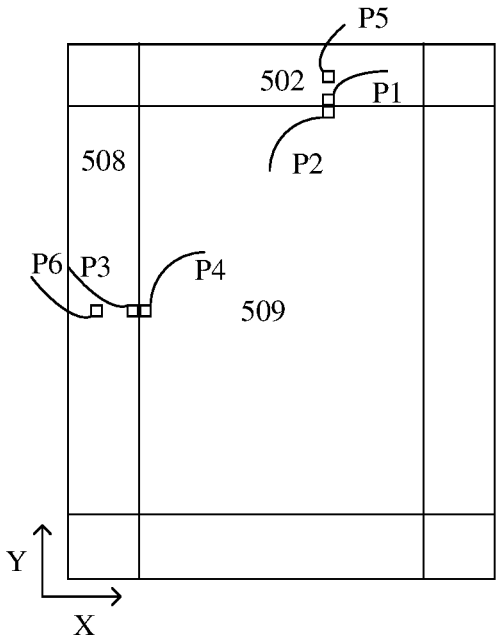
FIG. 7 is a schematic diagram of a pixel block in a display panel according to an embodiment of the present disclosure.

For example, as shown in FIG. 7, the pixel block P1 and the pixel block P2 adjacent thereto are in column alignment (i.e., are aligned with each other in the column direction, i.e., the Y direction), and the pixel block P3 and the pixel block P4 adjacent thereto are in row alignment (i.e., are aligned with each other in the row direction, i.e., the X direction). If a pixel block P5 (the third pixel block) and the pixel block P1 in the edge region 502 are on the same column, the pixel compensation parameter of the pixel block P1 is used as a pixel compensation parameter of the pixel block P5, so that the pixel compensation parameter of the pixel block P5 is consistent with that of the pixel block P2. If a pixel block P6 (the third pixel block) and the pixel block P3 in the edge region 508 are on the same row, the pixel compensation parameter of the pixel block P3 is used as a pixel compensation parameter of the pixel block P6, so that the pixel compensation parameter of the pixel block P6 is consistent with that of the pixel block P4.

Figure 8A:
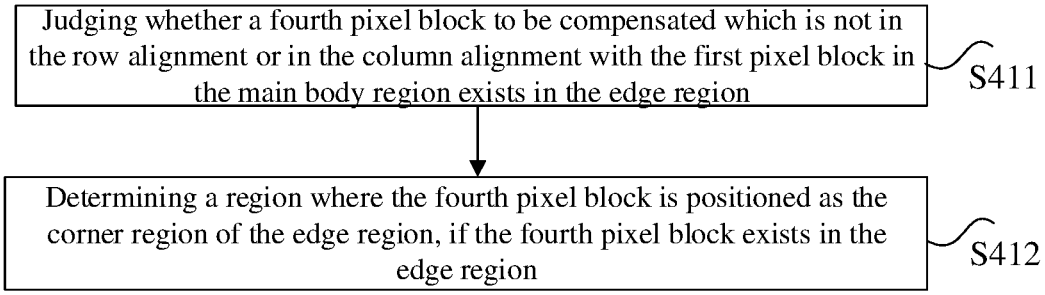
FIG. 8A is a logic diagram of judgment on a corner region according to an embodiment of the present disclosure.

FIG. 8A is a logic diagram of judgment on a corner region according to an embodiment of the present disclosure. As shown in FIG. 8A, before acquiring the pixel compensation parameter of at least one pixel block in the main body region as the pixel compensation parameter of the pixel block to be compensated, the method further comprises:

S411: judging whether a fourth pixel block to be compensated which is not in the row alignment or in the column alignment with the first pixel block in the main body region exists in the edge region.

S412: determining a region where the fourth pixel block is positioned as the corner region of the edge region, if the fourth pixel block exists in the edge region.

For example, the edge regions comprise the edge region 501, the edge region 503, the edge region 505 and the edge region 507, the pixel compensation parameters of the fourth pixel blocks positioned in the same corner region (which means one of the four corner regions) are all the same and are equal to the pixel compensation parameter of the first pixel block which is the closest to the corner region.

For example, the fourth pixel block can be subjected to weight distribution, and according to weight distribution, the compensation parameter of the fourth pixel block in the edge region is regulated.

For example, performing weight distribution on the fourth pixel block in the edge region comprises: for each fourth pixel block, with respect to (the second pixel block) the third pixel block in row alignment or (the second pixel block) the third pixel block in column alignment, establishing a weight distribution coordinate system, the third pixel block herein being the closest to the fourth pixel block; and according to the weight distribution coordinate system, performing weight on the fourth pixel block in the edge region.

It should be noted that the fourth pixel block can be positioned in a plurality of corner regions, e.g., the edge region 501, the edge region 503, the edge region 505 and the edge region 507. In other words, each pixel block in the edge region 501, the edge region 503, the edge region 505 and the edge region 507 is not aligned with the pixel block in the main body region 509 in the row direction and the column direction.

Figure 8B:
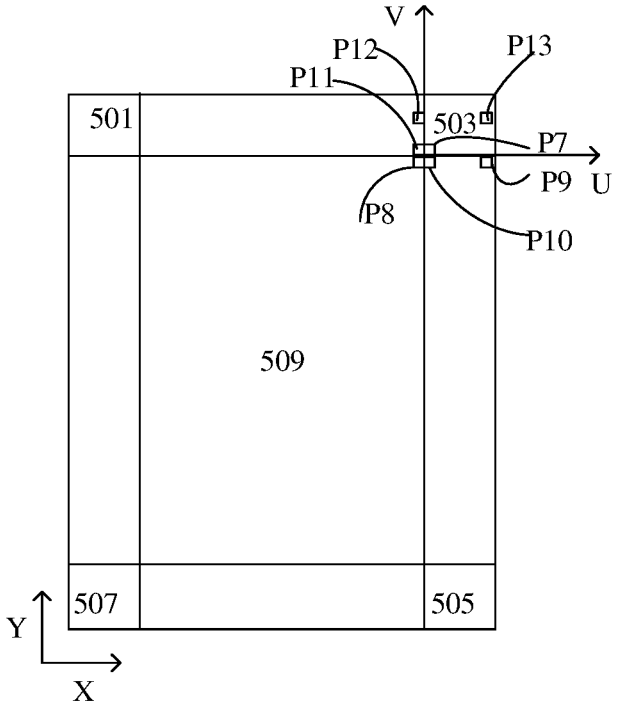
FIG. 8B is a schematic diagram of a pixel block in a display panel according to an embodiment of the present disclosure.

For example, the weight distribution coordinate system as shown in FIG. 8B can be established in the corner region 503, a weight is allocated to each fourth pixel block according to the corresponding weight distribution coordinate system, and then the pixel compensation parameter of the fourth pixel block is regulated.

For example, as shown in FIG. 8B, a second pixel block P11 positioned in the edge region is aligned with a first pixel block P8 positioned in the main body region in the Y direction, and thus, a pixel compensation parameter of the first pixel block P8 is used as a pixel compensation parameter of the second pixel block P11. Similarly, the pixel compensation parameter of the first pixel block P8 is used as a pixel compensation parameter of a second pixel block P10. A third pixel block P12 positioned in the edge region is aligned with the second pixel block P11 in the Y direction, and thus, a pixel compensation parameter of the third pixel block P12 is regulated to be equal to that of the second pixel block P11, i.e., the pixel compensation parameter of the second pixel block P11 is used as the pixel compensation parameter of the third pixel block P12. Similarly, a pixel compensation parameter of a third pixel block P9 is regulated to be equal to that of the second pixel block P10. Therefore, the pixel compensation parameters of the second pixel block P11, the second pixel block P10, the third pixel block P12 and the third pixel block P9 are all equal to that of the first pixel block P8.

For example, as shown in FIG. 8B, it is assumed that offset and gain values of the regulated pixel compensation parameters of the third pixel block P12 respectively are 24 and 20; and offset and gain values of the regulated pixel compensation parameters of the pixel block P9 respectively are 24 and 20. For the weight distribution coordinate system as shown in FIG. 8B, it should be noted that weights corresponding to coordinate axes of the weight distribution coordinate system are sequentially and orderly changed. For example, position coordinates of a fourth pixel block P13 are acquired according to a position of the fourth pixel block P13, and the position coordinates correspond to a weight distributed to the fourth pixel block P13. For example, when a distance between the fourth pixel block P13 and the third pixel block P9 in column alignment with the fourth pixel block P13 is a size of 2 pixel blocks and a distance between the fourth pixel block P13 and the third pixel block P12 in row alignment with the fourth pixel block P13 is a size of 4 pixel blocks, a weight allocated in the row direction is 4, and a weight allocated in the column direction is 2. Therefore, the weight (u, v) allocated to the fourth pixel block P13 is (4, 2), and thus, the offset and gain values of the fourth pixel block P13 respectively are that: Offset=[(24*4)±(24*2)]/(2+4)=24; and Gain=[(20*4)±(20*2)]/(2+4)=20. Therefore, the offset and gain values of the regulated pixel compensation parameters of the fourth pixel block P13 respectively are 24 and 20, and the pixel compensation parameters are equal to those of the third pixel block P9 (P12), so that the pixel compensation parameters of the fourth pixel block P13 are equal to those of the first pixel block P8. Similarly, for other corner regions 501, 505 and 507, the same conclusion also can be obtained.

For example, after regulating the pixel compensation parameter of the edge region, the method further comprises: reading the pixel compensation parameter of the pixel block in the main body region of the display panel and the regulated pixel compensation parameter of the pixel block to be compensated in the edge region of the display panel; and inputting the pixel compensation parameter of the main body region and the regulated pixel compensation parameter of the edge region into the display panel so as to compensate a display operation for the display panel. Namely, the obtained pixel compensation parameter of the main body region and the obtained regulated pixel compensation parameter of the edge region are stored in the storage apparatus of the display panel for the display panel to retrieve when performing the display operation so as to compensate display data which is to be used for the display operation, and the compensated display data is used for the display operation.

For example, after the offset and gain values of each pixel block of the display panel are obtained, the control unit of the optical compensation device performs calculation, and optical compensation calculation is carried out by utilizing the Demura compensation algorithm, e.g., q=as+b, where q is an optical compensation output, s is an input, a is a value of gain, and b is a value of offset.

It should be noted that the pixel compensation parameters include, but are not limited to, the offset and the gain.

For example, the display panel in the embodiments of the present disclosure can be a flexible screen (a bendable display panel which is also called as a flexible display panel), and for example, the flexible screen can be curled and folded as required and can be relatively varied in appearance. The display panel also can adopt a plastic substrate, and by virtue of a thin film packaging technology, a protection film is adhered to the back of the display panel, so that the display panel becomes bendable and difficult to break. The flexible display panel can be very thin and be mounted on a flexible material such as plastic or a metal foil and the like.

Figure 9A:
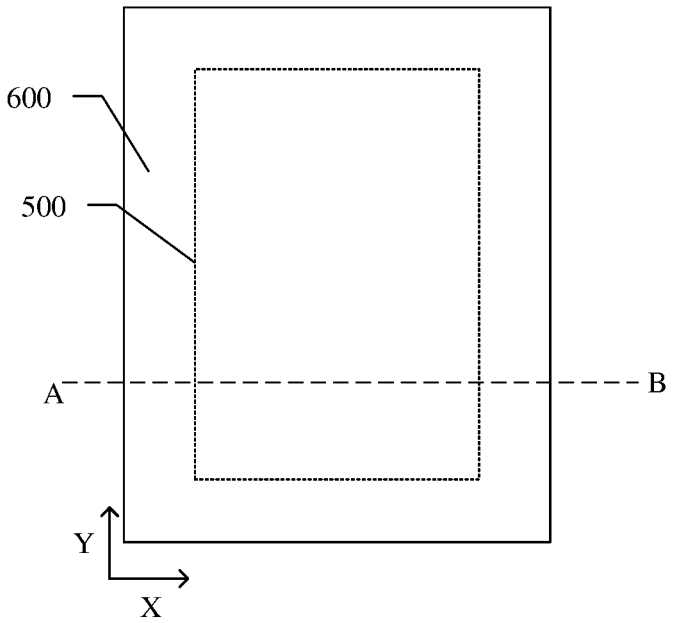
FIG. 9A is a plane structural schematic diagram of a display panel provided by an embodiment of the present disclosure.
Figure 9B:
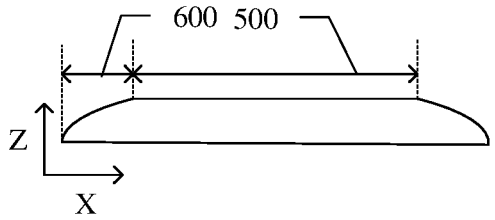
FIG. 9B is a sectional structural schematic diagram of the display panel as shown in FIG. 9A.

For example, FIG. 9A is a plane structural schematic diagram of a display panel provided by an embodiment of the present disclosure, and FIG. 9B is a sectional structural schematic diagram of the display panel as shown in FIG. 9A. As shown in FIG. 9A and FIG. 9B, the display panel comprises a curved screen, and the curved screen comprises a plane portion 500 positioned in the main body region and a curved surface portion 600 positioned in the edge region. In other words, the plane portion 500 covers the main body region, and the curved surface portion 600 covers the edge region. The curved surface portion can be positioned at a side edge of the display panel, and a bending direction of the curved surface portion faces one side where a base substrate of the display panel is positioned, i.e., the curved surface portion is bent along a direction opposite to a Z direction as shown in FIG. 9B.

In the above-mentioned mode, the compensation parameter of the curved surface portion, i.e., the edge region, included in the curved screen of the display panel can be separately controlled, so that after the display panel in the edge region is subjected to optical compensation, the display panel is relatively uniform in overall brightness, which further can be used for weakening the afterimage.

It should be noted that in order to simply describe, the embodiments of the above-mentioned system, method and display device are described as a series of action or module combinations, but those skilled in the art should know that the present disclosure is not limited to the described action sequence or module connection, because according to the present disclosure, some steps can be performed by adopting other sequences or simultaneously, and some modules can adopt other connection modes.

Those skilled in the art also should know that the embodiments described in the specification all belong to one embodiment, and the related actions and modules are not necessary for the present disclosure.

In the above-mentioned embodiments of the present disclosure, there are different emphases for description on each embodiment, and the part which is not described in detail in a certain embodiment can refer to related description in other embodiments.

In several embodiments provided by the present disclosure, it should be understood that the disclosed technical contents can be implemented in other modes. The apparatus embodiments described above merely are exemplary, for example, partitioning of the unit merely is logic functional partitioning and can adopt other partitioning modes in the actual implementing process, and for example, a plurality of units or components can be combined or can be integrated into another system, or some characteristics can be omitted or not executed. In addition, the displayed or discussed mutual coupling or direct coupling or communication connection may be indirect coupling or communication connection by some interfaces, units or modules, and may be in an electrical form or other forms.

The units illustrated as separation parts can be or also can be not physically separated, and the units as display parts can be or also can be not physical units, i.e., the units can be positioned in one place, or also can be distributed onto a plurality of network units. Part or all of units can be selected according to actual demands to fulfill the aim of the solutions of the embodiments.

In addition, each functional unit in each embodiment of the present disclosure can be integrated into one processing unit, or each unit can separately and physically exist, or two or more units also can be integrated into one unit. The integrated unit not only can be implemented in a form of hardware, but also can be implemented in a form of a software functional unit.

If the integrated unit is implemented in the form of the software functional unit and is sold or used as an independent product, the integrated unit can be stored in a computer readable storage medium. Based on such understanding, the technical solutions of the present disclosure in essence or the part of the technical solutions, which makes contribution to the prior art, or all or part of the technical solutions can be reflected in a form of a software product, and the computer software product is stored in one storage medium and comprises a plurality of instructions for enabling one computer device (which may be a PC, a server or a network device and the like) to execute all or part of the steps in the method according to each embodiment of the present disclosure. The above-mentioned storage medium comprises a volatile storage medium or a non-volatile storage medium, e.g., various media capable of storing program codes, such as a U disk, a Read-Only Memory (ROM), a Random Access Memory (RAM), a mobile hard disk, a diskette or a compact disc and the like.

The above is only the preferred embodiment of the present disclosure, it should be pointed out that for a person of ordinary skill in the art, without departing from the principles of the present disclosure, several improvements and embellishments can also be made, and these improvements and embellishments should also be regarded as the scope of protection of the present disclosure.

What is claimed is:

1. An optical compensation method for a display panel, wherein the display panel comprises a main body region and an edge region located at a periphery of the main body region, the optical compensation method comprises:

selecting a pixel block to be compensated in the edge region; and acquiring a pixel compensation parameter of at least one pixel block in the main body region as a pixel compensation parameter of the pixel block to be compensated, wherein acquiring the pixel compensation parameter of the at least one pixel block in the main body region as the pixel compensation parameter of the pixel block to be compensated comprises:

acquiring a pixel compensation parameter of a first pixel block in the main body region, which is the closest to a second pixel block to be compensated, as a pixel compensation parameter of the second pixel block, wherein pixel blocks on the display panel are arranged along a row direction and a column direction, and acquiring the pixel compensation parameter of the at least one pixel block in the main body region as the pixel compensation parameter of the pixel block to be compensated further comprises:

determining an alignment mode of the second pixel block and the first pixel block, wherein the alignment mode comprises row alignment or column alignment; and using the pixel compensation parameter of the second pixel block as a pixel compensation parameter of a plurality of third pixel blocks to be compensated positioned in a same row or a same column with the second pixel block according to the alignment mode, before acquiring the pixel compensation parameter of the at least one pixel block in the main body region as the pixel compensation parameter of the pixel block to be compensated, further comprising:

judging whether a fourth pixel block to be compensated which is not in the row alignment or in the column alignment with the first pixel block in the main body region exists in the edge region; and determining a region where the fourth pixel block is positioned as a corner region of the edge region if the fourth pixel block exists in the edge region.

2. The optical compensation method according to claim 1, wherein the pixel compensation parameter of the first pixel block which is the closest to the corner region is used as a pixel compensation parameter of the fourth pixel block in the corner region.

3. The optical compensation method according to claim 2, wherein the corner region comprises a plurality of sub-corner region, each sub-corner region comprises a plurality of fourth pixel blocks, and pixel compensation parameters of the plurality of fourth pixel blocks positioned in a same sub-corner region are all the same.

4. The optical compensation method according to claim 1, wherein acquiring the pixel compensation parameter of the at least one pixel block in the main body region of the display panel comprises:

acquiring picture data displayed by the display panel;

identifying a color difference or brightness difference between the at least one pixel block in the main body region and at least one pixel block in a tested picture on the basis of color distribution or brightness distribution of the picture data; and acquiring the pixel compensation parameter of the at least one pixel block in the main body region by utilizing a compensation algorithm according to the color difference or brightness difference between the at least one pixel block in the main body region and the at least one pixel block in the tested picture.

5. The optical compensation method according to claim 4, wherein the pixel compensation parameter comprises an offset and a gain which are calculated according to the at least one pixel block in the main body region.

6. The optical compensation method according to claim 4, wherein acquiring the picture data displayed by the display panel comprises: adopting a camera to shoot to acquire the picture data displayed by the display panel.

7. The optical compensation method according to claim 4, wherein the compensation algorithm comprises an optical compensation algorithm.

8. The optical compensation method according to claim 4, after acquiring the picture data displayed by the display panel, further comprising:

identifying the color difference or brightness difference between the pixel block in the display panel and the pixel block in the tested picture on the basis of the color distribution or brightness distribution of the picture data, and partitioning the display panel into the edge region and the main body region according to a size of the color difference or brightness difference, wherein the color difference or brightness difference of the edge region is greater than that of the main body region.

9. The optical compensation method according to claim 1, further comprising:

reading the pixel compensation parameter of the pixel block in the main body region of the display panel and a regulated pixel compensation parameter of the pixel block to be compensated in the edge region; and inputting the pixel compensation parameter of the main body region and the regulated pixel compensation parameter of the edge region into the display panel so as to compensate a display operation for the display panel.

10. The optical compensation method according to claim 1, wherein selecting the main body region and the edge region of the display panel comprises:

acquiring a brightness test result of the display panel, and partitioning the display panel into the edge region with low brightness and the main body region with high brightness according to the test result; or partitioning the display panel into a plurality of regions in advance, wherein the plurality of regions comprise at least one edge region and at least one main body region.

11. The optical compensation method according to claim 1, wherein the display panel comprises a curved screen, and the curved screen comprises a plane portion positioned in the main body region and a curved surface portion positioned in the edge region.

12. The optical compensation method according to claim 1, wherein the pixel block comprises N*M pixels, N is an integer between 1 and 10, and M is an integer between 1 and 10.

13. An optical compensation device, comprising:

a processor; and a memory, configured to store a computer program instruction, the computer program instruction being applicable to be loaded by the processor and execute the optical compensation method for the display panel according to claim 1.

14. The optical compensation device according to claim 13, further comprising:

a camera, configured to shoot a picture displayed by the display panel and send the picture into the processor so as to acquire the pixel compensation parameter of the at least one pixel block in the main body region of the display panel.

* * * * *